United States Patent [19]

de Szegheo

[11] 4,182,531

[45] Jan. 8, 1980

[54] DRUM HANDLING APPARATUS

[76] Inventor: Charles de Szegheo, Rte. 2, Box 79, Middletown, Va. 22645

[21] Appl. No.: 907,563

[22] Filed: May 19, 1978

[51] Int. Cl.[2] ..... B66C 1/66

[52] U.S. Cl. ..... 294/90; 414/622

[58] Field of Search ..... 294/90, 4, 104, 103; 214/650, 651, 653, 654, 620

[56] References Cited

U.S. PATENT DOCUMENTS

| | | | |
|---|---|---|---|
| 2,713,433 | 7/1955 | Gardner et al. | 214/654 |
| 2,827,184 | 3/1958 | Mueller | 214/654 |
| 3,794,371 | 2/1974 | Arbouw | 294/90 |

*Primary Examiner*—James B. Marbert

*Attorney, Agent, or Firm*—Jacobi, Lilling & Siegel

[57] ABSTRACT

Drum handling apparatus having a generally vertically oriented main frame member attachable to a standard tractor three-point lifting hitch. A base plate slidable under the drum to be lifted is attached in substantially transverse relation to the lower end of the main frame member, and a latch means engageable with the upper rim of the drum is pivotally attached to the upper end of the main frame member. Rearward movement of the apparatus causes the latch means to engage the upper rim of the drum and the drum is tilted rearwardly by contact with the frame member, allowing the base plate to be slipped beneath it. Operation of the tractor hitch elevates the drum handling apparatus to engage and lift the drum upon the base plate.

11 Claims, 8 Drawing Figures

DRUM HANDLING APPARATUS

BACKGROUND OF THE INVENTION

The present invention relates generally to the field of barrel or drum handling equipment, and more particularly to apparatus that is attachable to a farm tractor or the like for lifting a drum. It can also be used with accessory systems such as a spraying system, where the drum is used as a supply reservoir.

Generally, there are two main types of apparatus for lifting and handling individual barrels, drums or the like (hereinafter referred to only as drums). In a first type, the drum is engaged on its sides by a pair of pincers and is held by virtue of a squeezing action. In the second type, the drum is lifted from beneath. There are many manifestations in the prior art of each of these two types, and others that are variations and combinations of them. However, they all appear to suffer some disadvantages, especially from the standpoint of use in simple, low capacity situations, such as on a farm or in a small business operation.

The pincer type of drum handling system is speedy and needs very little space to operate. However, it requires the creation of a relatively powerful squeezing action against the sides of the drum, even when engagement is also made with one of the annular reinforcing shoulders of the drum. Because this system does not support the drum from beneath and does not positively lock onto the drum, it presents some safety hazards.

The chief disadvantages of the lift-type handling system is the requirement that the lift plate be positioned beneath the drum. This can be done by tilting the drum, or by simply forcing the lift plate beneath the drum. In most of the lift systems, the drum must be tilted by a second person, a luxury not available in many instances, and thus such a system does not lend itself well to use by farmers or in small businesses. Systems in which the lift plate is simply forced beneath the drum are usually difficult to use and cannot be used with heavy loads where it becomes very difficult to insert the lift plate.

SUMMARY OF THE INVENTION

The chief requirements for a drum handling apparatus to be used by farmers and the like are that it be simple in construction and operation, and that it require only one person to operate. The present apparatus meets these requirements, plus offering the additional feature of permitting the operator to load and unload without leaving his seat on the tractor or other vehicle.

The drum handling apparatus according to this invention is particularly well suited for use with vehicles such as farm tractors and fork lift trucks wherein a tiltable lift or lifting hitch mechanism is already installed, although the concept is not limited to those applications.

It is an object of this invention to provide an improved drum handling apparatus that is simple in construction and operation.

Another object of this invention is to provide an improved drum handling apparatus that requires only one person to operate.

A further object of this invention is to provide an improved drum handling apparatus that has a very high degree of safety.

Still another object of this invention is to provide an improved drum handling apparatus that can be used in conjunction with standard tractor lift hitches and the like.

Yet another object of this invention is to provide an improved drum handling apparatus than can be used with many types of vehicles.

A still further object of this invention is to provide an improved drum handling apparatus that can be operated from a position on the vehicle during loading and unloading.

The drum handling apparatus constructed in accordance with this invention is usable in conjunction with a tiltable lift mechanism such as the standard SAE three-point hitch used on the rear of farm tractors. However, it is also well suited for use with a fork-lift truck or dozer blade lift mechanism, or it could be constructed as part of a tiltable mechanism for attachment to virtually any vehicle. The drum is handled from beneath by a a base plate, and is locked thereupon by interaction with the base plate itself and with a latch means that engages the top rim thereof. The drum is tilted simply by moving the vehicle upon which the handling apparatus is mounted toward the drum so that the apparatus contacts the upper edge of the drum and causes it to tilt to the extent necessary to allow engagement and disengagement of the base plate. The latch engages automatically and is disengaged manually. It is not necessary for the vehicle operator to leave his seat in the vehicle to operate the drum handling device.

The present apparatus comprises four components: a main frame member, base plate, latch means, and hitch attachment means. The frame member is generally vertically oriented, and is normally movable to some degree by the hitch mechanism on the vehicle between a tilted position for loading and unloading a drum and an upright position for carrying the drum, although the drum may be carried in the tilted position. The base plate is attached to the lower end of the frame member in substantially transverse relation thereto. It slides under the tilted drum during the loading operation, and lifts by engaging a portion of the bottom of the drum. Mounted on the apparatus are means for centering the drum on the base plate. On the surface of the base plate, upstanding locking means are provided that engage the inside of the bottom rim of the drum to keep it from sliding off the base plate.

Attached to the upper portion of the frame member is a latch means which is adapted to engage the upper rim of the drum when the drum is moved into the loading position. The latch means is biased, by gravity or otherwise, to the engaged position so that it engages the upper rim during the early stages of the loading operation. It is manually disengaged, and can be made to be adjustable to accommodate drums of different heights.

Also attached to the frame member is a hitch attachment means by which the handling apparatus can be attached to a vehicle such as a tractor or the like. The vehicle hitch or lift means preferably allows the drum handling apparatus to be inclined toward the drum during loading and unloading and, ideally, moves the drum to a more upright position as it is being lifted. An example of such a hitch is the standard SAE three-point hitch, which by proper adjustment of the hitch arms can provide the above-described movement. Virtually any hitch that allows the frame member to be inclined toward the drum can be used, with suitable attachment points being provided on the main frame member of the present apparatus.

Accordingly, the present invention provides a drum handling apparatus that is simple in construction an operation.

Figure 1:
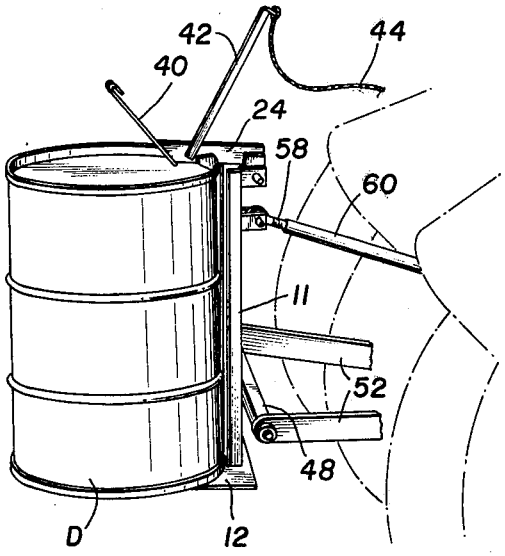
FIG. 1 is a perspective view of the drum handling apparatus of the present invention showing a drum secured in position for transport.

FIGS. *3a*, *3b*, *3c*, and *3d* are side elevational views of the present apparatus, showing the four stages of loading a drum thereon; and FIGS. *4a* and *4b* are side elevational views of the present apparatus, showing the two stages of unloading a drum therefrom.

DESCRIPTION OF THE PREFERRED EMBODIMENT

In the following description, the concepts of the invention are explained within the context of a drum handling apparatus installed upon the three-point lift hitch commonly used on farm tractors or the like. The device is particularly useful to farmers, because it is simple in construction and operation and can be operated by one person without leaving the tractor seat. However, as hereinbefore stated, it can be used in any situation where tilting and lifting action can be provided, such as other types of farm tractor hitches, fork-lift trucks and even dozer blade lifts. The teachings of the present invention could also be utilized in the construction of a small vehicle for the sole purpose of handling drums, which could conceivably be of a type that is manually moved and has a manually operated lift mechanism. The drum illustrated in the drawings is a standard "oil drum" type having an upstanding annular upper rim and a downward annular lower rim.

Figure 2:
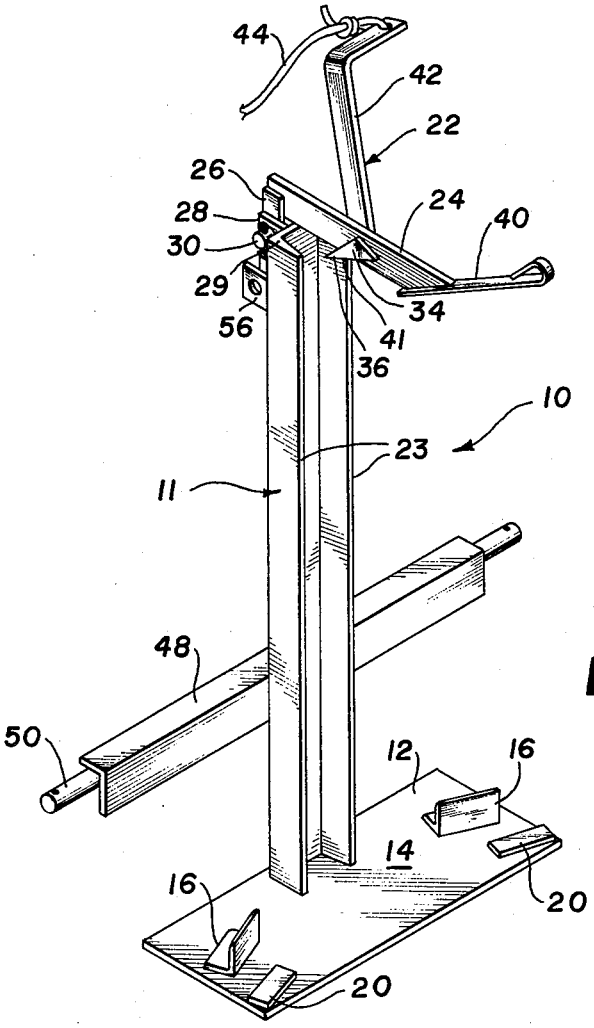
FIG. 2 is an enlarged perspective view of the drum handling apparatus of FIG. 1, with the drum removed.

The construction of the preferred embodiment of the invention is best shown in FIG. 2. The apparatus 10 of the present invention comprises a main frame member 11 which may be of any suitable construction. The cross-section of frame member 11 can be that of a U-shaped channel, as shown, or other conventional types such as an "I" or circular cross section. Frame member 11 is preferably straight, and is of height sufficient to accommodate a desired drum size, such as a standard 55 gallon drum.

Attached to the bottom end of frame member 11 and in substantially transverse relation thereto is a base plate 12. The width of base plate 12 is preferably sufficient to contact enough of the rim and/or bottom of a drum to support it without wobbling. Base plate 12 need not extend very far radially inwardly with respect to the drum. Mounted on the upper surface 14 of base plate 12 are a pair of upstanding drum centering stops 16. These are advantageously so aligned with respect to the innermost edges 20 of frame member 11 as to be engaged substantially concurrently therewith by a drum mounted in substantially centered relation on the base plate 12. Accordingly, it will be readily seen that centering stops 16 insure that a drum is centered on base plate 12. The height of centering stops 16 is advantageously sufficient to contact the drum as the inclined drum handling apparatus 10 is moved toward the tilted drum, as shown in FIG. *3c*, although the centering stops have been eliminated from FIG. *3c* for clarity. The centering stops 16 could alternatively be mounted on frame member 11.

Also mounted on the upper surface 14 of base plate 12 are a pair of upstanding locking blocks 20 that are of lesser height than that of the centering stops 16. The function of locking blocks 20 is to keep the drum from sliding off the base plate 12. They are so located on base plate 12 that they are radially inwardly of the lower rim of a drum when it is seated in the carrying position on surface 14 shown in FIG. *3d*. Thus, the drum is constrained against major movement unless it is first disengaged from blocks 20. The height of locking blocks 20 is so small that the drum rim is not engaged during loading and unloading. As an alternative to blocks 20, base plate 12 could be provided with a groove to receive the rim of the drum.

Positioned at the upper end of frame member 11 is a latch means denoted generally by the numeral 22. Latch means 22 comprises a latch arm 24 that is pivotally mounted on frame member 11 in any suitable manner such as by an attachment link 26 on latch arm 24, a pivot mount 28 on frame member 11, and a pivot pin 30 securing the link 26 and mount 28 together. A drum rim latch on pawl 34 having a latch contact surface 36 is fixedly attached to latch arm 24 at a point so spaced from a plane through frame member edges 23 that contact surface 36 can engage the inner surface of the upstanding upper annular rim of a drum when latch arm 24 is in the down or locking position, as shown in FIGS. 1 and *3b*. Attached to the free end of latch arm 24 is an upwardly and outwardly inclined slide member 40, whose purpose is to engage the top of a drum during a loading operation so that rim latch 34 is lifted over the upper rim of the drum until contact surface 36 has passed over it. This action is shown in FIGS. *3a* and *3b*. It should be noted that lower surface 41 of rim latch 34 is inclined upwardly and outwardly in a manner similar to slide member 40. Finally, a release lever 42 is attached to latch arm 24 to cause arm 24 to pivot upwardly to release the latch 34 from the drum rim when line 44 is pulled by the operator of the tractor or other vehicle.

Downward movement of latch arm 24 is limited by contact with the top surface 29 of frame member 10. Any other suitable means can be provided to perform this function.

Although not shown, any suitable means can be provided to allow vertical adjustment of latch means 22 to accommodate of different height. For example, frame member 11 could be provided at its upper end with a central slot through which latch arm 24 extends, and a plurality of pivot mounting openings could be provided in an elongated pivot mount 28. It would also be possible to replace or augment the latch means illustrated with a spring arrangement or other biasing means to urge it to the engaged position.

Means are also provided for attaching the apparatus 10 to a lift hitch, in this case a standard three-point tractor hitch. A substantially transverse hitch bar 48 attached to frame member 11 supports a shaft 50 which is adapted to be pivotally connected to lower hitch arms 52 on a tractor (FIG. 1). The upper hitch connection is in the form of a bracket 56, to which upper hitch arm 58 of a tractor (FIG. 1) may be pivotally attached. A turnbuckle 60 or other suitable means allows adjustment of the length of upper hitch arm 58.

The operation of the present apparatus 10 during loading is illustrated in FIGS. *3a*–*3d*, from which centering stops 16 and locking blocks 20 have been omitted for clarity. Looking first to FIG. *3a*, upper and lower hitch arms 58 and 52 on tractor T are moved to a lowered position, wherein the leading edge of base plate 12 is slightly above the ground. Turnbuckle 60 has been previously adjusted so that frame member 11 is at an angle to the ground, i.e., inclined toward drum D. The leading edge of slide member 40 is aligned with or rests upon upper drum rim 72.

Figure 3A:
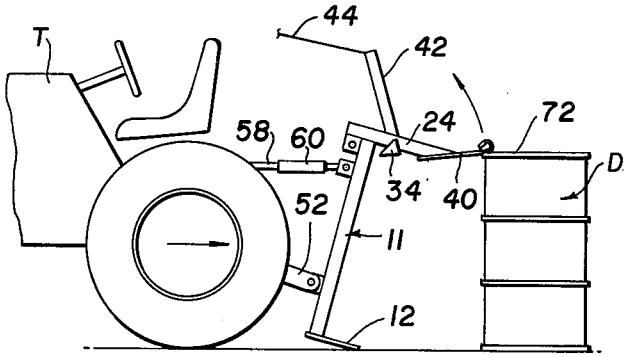
Figure 3B:
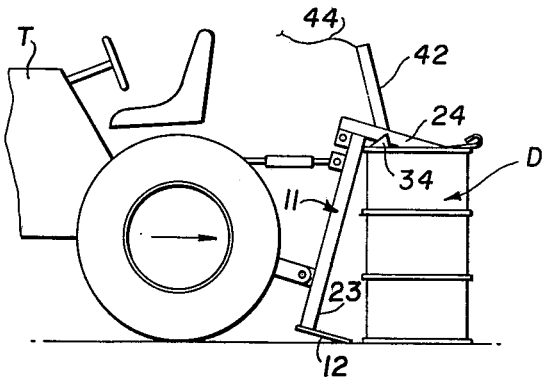
Figure 3C:
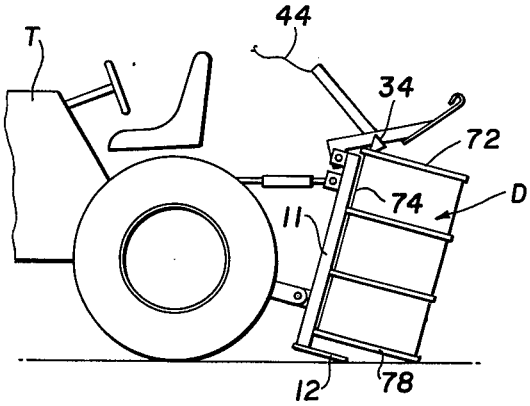
Figure 3D:
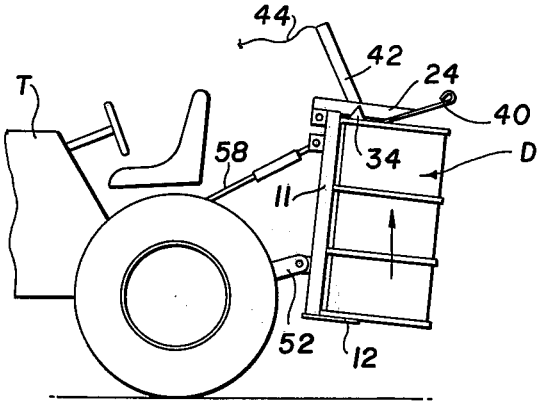

The tractor is now driven rearwardly toward drum D, whereupon the upper rim 72 makes contact with a drum contact surface which in this case is the edges 23 of frame member 11 (FIGS. 2 and 3*b*). As the movement of the tractor continues, drum D is tilted away from the tractor until the drum side 74 is generally aligned with frame member edges 23 along the length thereof. Rearward tractor movement is then stopped. At this point (FIG. 3*c*), base plate 12 has moved beneath the drum D and latch 34 has been moved radially inwardly with regard to the drum so that contact surface 36 has dropped in behind the upper drum rim 72 (FIGS. 3*b* and 3*c*). Also, the botton portion of drum D has contacted centering stops 16, so that the drum is properly aligned with the apparatus 10. The tractor lifting mechanism is now operated to raise hitch arms 52, 58 and the drum handling apparatus 10 connected thereto. In the course of this lifting action, the lower drum rim 78 is seated upon surface 14 of base plate 21, positioned between centering stops 16 and locking blocks 20. As the drum handling apparatus 10 rises with respect to the drum, latch 24 rotates with respect to the frame member 11 and thus latch 34 stays in the engaged or locking position (FIG. 3*d*).

Figure 4A:
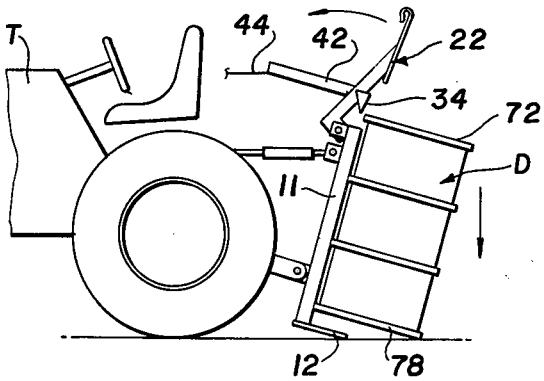
Figure 4B:
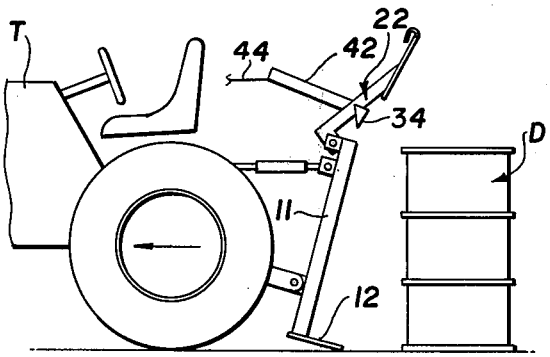

To unload the drum, the hitch arms 52, 58 are lowered until the lower rim 78 of drum 70 contacts the ground and is tilted to the position shown in FIG. 4*a*, wherein lower rim 78 is clear of locking blocks 20. The latch 34 is then pivotally released via release lever 42 and line 44 pulled by the operator of the tractor (FIG. 4*a*), and the tractor moved away, thereby allowing the drum D to stand upright on the ground (FIG. 4*b*).

It should be noted that while drum D is in the lifted position (FIG. 3*a*) it can be used as part of a system such as a spraying system, in which a suction or other line is extended inside the drum to remove its contents.

No doubt, modifications and variations to the above-described preferred embodiment will become apparent to those skilled in the art, and it should therefore be noted that the purpose of the preferred embodiment is simply to illustrate the inventive concepts of the present apparatus. Particularly, variations of the latch means, and the drum centering means may come quickly to mind, as might different means for attaching the device to a lift hitch. The scope of this invention is not, therefore, confined to the embodiment shown, but is limited only by the scope of the appended claims.

What is claimed is:

1. Apparatus for handling a drum or the like, comprising:

a frame member having an upper end and a lower end, said frame member having a drum contact surface on the upper end thereof for engaging the upper portion of a drum when it is moved into contact with an upstanding drum to tilt said drum, base support means attached to the lower end of said frame member extending generally laterally outwardly therefrom a distance sufficient to engage and support a portion of the bottom of a drum, latch means movably secured to the upper end of said frame member and extending generally laterally outwardly therefrom, said latch means comprising a latch engagable with the upper portion of a drum when the drum is engaged by said contact surface and said latch means is in a locking position, means for moving said latch means to a release position wherein said latch is out of engagement with the upper drum portion, said latch means further comprising a latch arm pivotally mounted on the upper end of said frame member above said drum contact surface and movable in a plane substantially through said frame axis between said locking position and said release position, said latch being mounted on said latch arm and extending downwardly therefrom, and attaching means on said frame member for permitting attachment of said apparatus to a lift mechanism.

2. The apparatus of claim 1 further comprising means for engaging and centering said drum with respect to said frame member.

3. The apparatus of claim 1 wherein said latch extends downwardly and is adapted to engage the inner surface of the upstanding upper rim of a drum.

4. The apparatus of claim 1 further comprising locking means on the lower end of said frame member for engaging the lower rim of a drum to substantially prevent movement thereof laterally with respect to said frame member.

5. The apparatus of claim 1 wherein said base support means comprises a base plate extending outwardly in substantially transverse relation to said frame member, and further comprising upstanding locking means on said base plate spaced from said frame member and being of height sufficient to engage the inside surface of the lower rim of a drum when said rim is resting on said base plate to limit lateral movement of the drum with respect to said frame member.

6. The apparatus of claim 5 wherein said base plate extends outwardly a distance less than the radius of the drum to be handled.

7. The apparatus of claim 5 further comprising centering means on said base plate for engaging and centering the drum with respect to said frame member.

8. The apparatus of claim 1 wherein said latch means further comprises slide means mounted on the outer portion of said latch arm and having an inclined surface engageable with the upper surface of a drum as the apparatus is being moved toward the drum, whereby said latch arm is maintained in a release position by said slide means so that said latch moves over the upper rim of the drum before engaging the inner surface thereof.

9. The apparatus of claim 8 further comprising means for limiting the downward pivotal movement of said latch arm so that said inclined surface of said slide means is in alignment with the upper surface of a drum to be handled by said apparatus.

10. Apparatus for handling drums or the like having an upper rim and a lower rim, comprising:

an elongated frame member having an upper end and a lower end, means for attaching said frame member to a lift mechanism on a vehicle, a base plate attached to the lower end of said frame member and extending generally laterally outwardly therefrom, drum centering means mounted on said base plate for substantially aligning and centering a drum to be handled with respect to said frame member and said base plate, raised stop means on said base plate and spaced laterally from said frame member so as to be disposed in juxtaposition to and radially inwardly of the lower rim of a drum when the drum is seated upon said base plate surface, a latch arm pivotally mounted on said upper end of said frame member and extending generally laterally outwardly therefrom, a latch extending downwardly from said latch arm and spaced laterally from said frame member a distance sufficient to enable said latch to engage the inside of the upper rim of a drum when the upper rim is in close proximity to said frame member, said latch arm being movable between a lower engaged position wherein said latch is in engagement with the upper rim of a drum and an upper release position wherein said latch is removed from said upper rim, an upwardly and outwardly extending slide member on and spaced laterally outwardly of said latch, said slide member being positioned to engage the upper surface of a drum in advance of said latch as said frame member is being moved toward the drum so that said latch arm is lifted and said latch is moved over the upper surface of the drum during the loading of the drum, and release means on said latch arm for selectively pivoting said latch arm to said release position.

11. Apparatus for handling a drum or the like, comprising:

a frame member having an upper end and a lower end, said frame member having a drum contact surface on the upper end thereof for engaging the upper portion of a drum when it is moved into contact with an upstanding drum to tilt said drum, base support means attached to the lower end of said frame member and extending generally laterally outwardly therefrom a distance sufficient to engage and support a portion of the bottom of a drum, said base support means comprising a base plate extending outwardly in substantially transverse relation to said frame member, and upstanding locking means on said base plate spaced from said frame member and being of a height sufficient to engage the inside surface of the lower rim of a drum when said rim is resting on said base plate to limit lateral movement of the drum with respect to said frame member, latch means movably secured to the upper end of said frame member and extending generally laterally outwardly therefrom, said latch means comprising a latch engageable with the upper portion of a drum when the drum is engaged by said contact surface and said latch means is in a locking position.

means for moving said latch means to a release position wherein said latch is out of engagement with the upper drum portion, attaching means on said frame member for permitting attachment of said apparatus to a lift mechanism, and centering means on said base plate for engaging and centering the drum with respect to said frame member, said centering means comprising upstanding members mounted on said base plate and engagable with the lower portion of the drum.

* * * * *